US006109991A

United States Patent [19]

McClaskey

[11] Patent Number: 6,109,991

[45] Date of Patent: Aug. 29, 2000

[54] TOWABLE WATERSPORT BOARD

[76] Inventor: Darryl W McClaskey, 12552 Hinton Way, Santa Ana, Calif. 92705

[21] Appl. No.: 09/058,374

[22] Filed: Apr. 9, 1998

[51] Int. Cl.[7] ..... B63B 35/85

[52] U.S. Cl. ..... 441/70; 441/65

[58] Field of Search ..... 441/65, 68, 70, 441/73, 74

[56] References Cited

U.S. PATENT DOCUMENTS 3,404,900 10/1968 Rippetoe ..... 441/70

4,871,337 10/1989 Harris ..... 441/74

5,514,017 5/1996 Chimiak ..... 441/65

*Primary Examiner*—Jesus D. Sotelo

*Attorney, Agent, or Firm*—Charles C. Logan, II

[57] ABSTRACT

A towable watersport board that requires laterally oriented foot bindings. It has an elongated core body and an elongated spar is recessed in its top surface. A plurality of longitudinally spaced apertures having a predetermined configuration are formed in the top surface of the spar and mechanical fastener inserts are positioned in the respective apertures in the elongated spar. The mechanical fastener inserts removably receive screws that secure the foot bindings. The core body is covered by a fiberglass coating.

13 Claims, 3 Drawing Sheets

TOWABLE WATERSPORT BOARD

BACKGROUND OF THE INVENTION

The invention relates to watersports and more specifically to towable watersport boards that require laterally oriented foot bindings.

One example of an existing towable watersport board is a wakeboard. The rider has laterally oriented foot bindings. Two threaded screws or bolts are used to fasten each of the front and rear foot bindings to the wakeboard. The screws are threaded into inserts that have been molded into the top surface of the wakeboard when the core body is formed. These inserts derive no strength from each other and are individual separate structures. The action of the rider working his feet against the bindings and the top surface of the wakeboard eventually cause these inserts to pull loose from the top surface of the wakeboard.

It is an object of the invention to provide a novel towable watersport board that incorporates an elongated spar that holds mechanical fastener inserts and eliminates the possibility of them being pulled out of the top surface of the watersport board.

It is also an object of the invention to provide a novel towable watersport board having an elongated spar that increases vibration absorption in the watersport board.

It is another object of the invention to provide a novel towable watersport board that incorporates structure that reinforces the strength of the board and (that can be used to) increase or decrease the flex of the board.

It is an additional object of the invention to provide a novel watersport board that incorporates structure that stores energy and releases it rapidly thereby allowing the rider to gain more hangtime in the air.

It is a further object of the invention to provide a novel towable watersport board that incorporates structure that can add to the torsion rigidity of the board thereby increasing the turning ability by 50% to 80% (that is quickness edge to edge).

SUMMARY OF THE INVENTION

The novel towable watersport board has been designed for use with laterally oriented foot bindings such as would be used with a wakeboard. It could also used in a like manner with towable surfboards. Incorporated in the novel watersport board is an elongated spar that is designed to give additional strength to the core body and also provide a structure in which mechanical fastener inserts can be incorporated. The mechanical fastener inserts would be internally threaded to receive the screws used for securing the foot bindings to the board.

The elongated spar can be made of different materials such as a solid strip of wood, a solid strip of plastic or a composite of different materials. The mechanical fastener inserts would be placed into the bottom of apertures in the elongated spar prior to the molding process. By making the mechanical fastener inserts wider at their bottom and narrower at their tops and configuring the apertures in the elongated spar to mate therewith makes it almost impossible to pull the inserts out or twist them loose inside the board.

By having the elongated spar extend along 75% to 90% of the board's length, at least 25% more strength would be provided for the core body of the board. Composite spar structures can be made stiffer or softer depending upon board design. One of the major objectives in manufacturing wakeboards is to increase the strength to weight ratio of the board. Lighter boards perform superior to heavy boards and stiffer boards are better than softer flexing boards. Prior art attempts to design a board that is both stiff and light has required twice as much cost in materials because more exotic high-tech material must be used in the manufacture. By using the novel elongated spar, a board can be constructed using standard fiberglass and still retain all of the characteristics of a more expensive board that cost twice as much to make. One example of an improved wakeboard would utilize a vertical laminated spar with different hard woods or composite plastics with glass fibers molded therein.

By reinforcing the wakeboard and making it stiffer by using the spar, several important functions are produced. When a wake boarder cuts into the wake he generates tension on the board causing it overflex or fold up from tip to tail. The elongated spar resists overflexing (which causes the board to slow down and skip out of the water) and retains its energy and releases it abruptly when the rider reaches the wake. This added energy helps the rider increase air time (vertically) and makes the board much more responsive and quicker reacting. This rebound effect is similar to a rear leaf spring in a pick-up truck suspension.

An additional benefit of the elongated spar is the increased vibration absorption. When the wakeboard is traveling in non-glassy water, harmonic vibrations are setup through the board and travel up into the rider's feet and legs. This vibration frequency causes fatigue. The elongated spar absorbs these vibrations and disburses them away from the feet and sends them back toward the end of the board and helps cancel the unwanted vibration frequencies.

An additional benefit of the elongated spar is that it prevents overflexing in landings and it also filters out the shock of landing flat. These landings also cause unwanted vibrations which it can cause injury to the riders feet and knees. overflexing on landings occurs when the board lands out in the flats and folds like a taco. This almost stops the board and causes it to rebound straight back up like a trampoline. The result is the rider will bounce up out of the water and fall on his face. The desired performance is to have the board land smoothly and not slow down so the rider can get ready to flow into his next trick.

The configuration of the spar can be varied to fit the desired requirements of the board. It might be a simple elongated rectangular piece of wood or plastic. It may taper to a point at its front and rear ends and also from top and bottom in height. In another embodiment it may have a bulbous portion at its front and rear ends. Likewise, two or three finger prongs can be designed in its forward or rear ends. The different variations would be limitless as long as they perform the desired function.

DESCRIPTION OF THE PREFERRED EMBODIMENT

The novel towable watersport board will now be described by referring to FIGS. 1–16 of the drawings.

Figure 1:
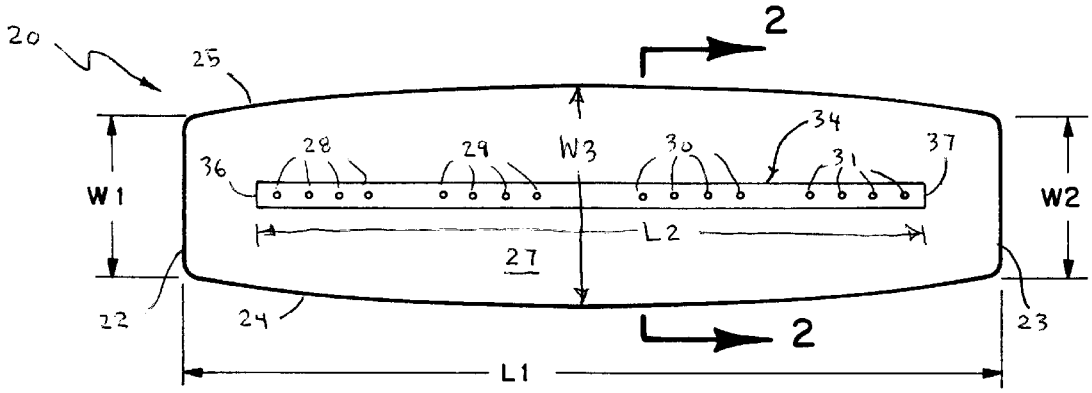
FIG. 1 is a top plan view of the novel towable watersport board.
Figure 2:
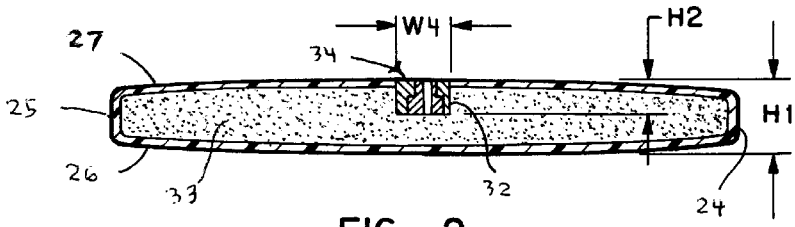
FIG. 2 is a cross sectional view taken along lines 2—2 of FIG. 1.

In FIGS. 1 and 2 the towable watersport board is generally designated numeral 20. It has a front edge 22, a rear edge 23, a left edge 24, a right edge 25 a bottom surface 26 and a top surface 27. Towable watersport board 20 has a length L1 in the range of 46–60 inches, a height H1 in the range of 0.75–2.5 inches and a width W3 in the range of 13–18 inches. Front edge 22 has a width W1 and rear edge 23 has a width W2 and both W1 and W2 are less than W3.

Figure 4:
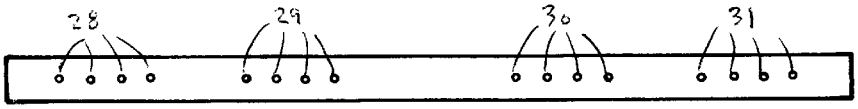
FIG. 4 is a top plan view of the elongated spar.
Figure 5:
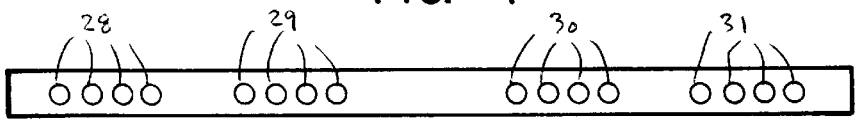
FIG. 5 is a bottom plan view of the elongated spar.

Towable watersport board 20 has an elongated core body 33 having an elongated recess 32 formed in its top surface. An elongated spar 34 has a front end 36 and a rear end 37. Spar 34 has a length L2 in the range of 40–54 inches and a width W4 in the range of 0.75–6.0 inches. A plurality of apertures 28–31 are formed in the top surface of elongated spar 34. These apertures form distinct groups along the length of the elongated spar. From front to rear they are identified as follows: forward front foot apertures group 28, rearward front foot apertures group 29, forward rear foot apertures group 30 and rearward rear foot apertures group 31. The laterally oriented foot bindings (not shown) can be adjusted forwardly or rearwardly along the length of the elongated spar 34 depending on the individual preference of the watersport board rider. As seen in FIGS. 4 and 5 the bottom end of apertures 28–31 have a greater width than their top ends. The configuration of the apertures can take any desired shape.

Figure 3:
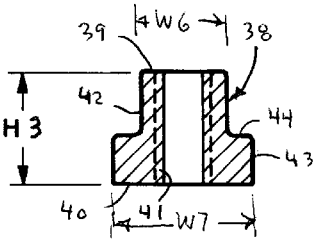
FIG. 3 is a vertical cross sectional view of one of the mechanical fastener inserts.

The mechanical fastener inserts 38 are illustrated in FIG. 3. They have a height H3, a top end 39, a bottom end 40 and internal threads 41 for removably receiving the mechanical fasteners of the foot bindings. The mechanical fastener inserts 38 have a tubular upper sleeve portion 42 having a width W6 and a lower sleeve portion 43 having a width W7. Lower sleeve portion 43 has a shoulder 44 adjacent its top end. As seen in FIG. 2, apertures 28–31 in elongated spar 34 have been configured to mateably receive the mechanical fastener inserts 38.

Figure 6:
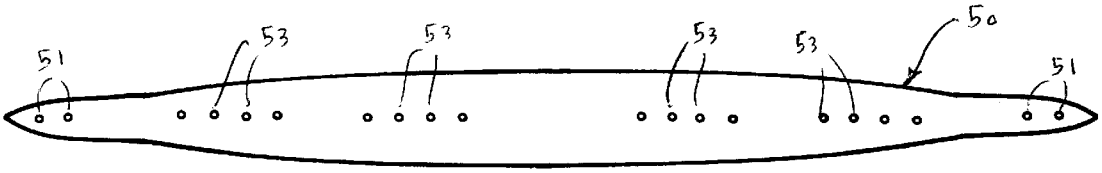
FIG. 6 is a top plan view of a first alternative embodiment of the elongated spar.
Figure 7:
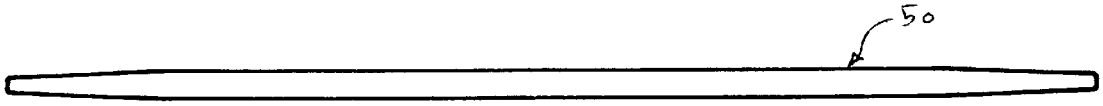
FIG. 7 is a side elevation view of the elongated spar illustrated in FIG. 6.
Figure 8:
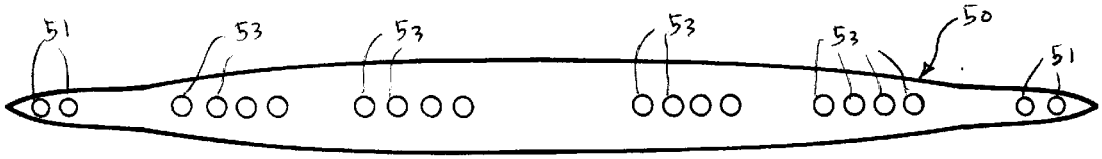
FIG. 8 is a bottom plan view of the elongated spar illustrated in FIGS. 6 and 7.

A first alternative embodiment elongated spar 50 is illustrated in FIGS. 6–8. Its front end and rear end narrow to a point and they have fin attachment apertures 51 therein. The apertures 53 have a smaller top diameter at their top end and a larger bottom diameter at their bottom end. The front and rear ends of the elongated spar also have a reduced height.

Figure 10:
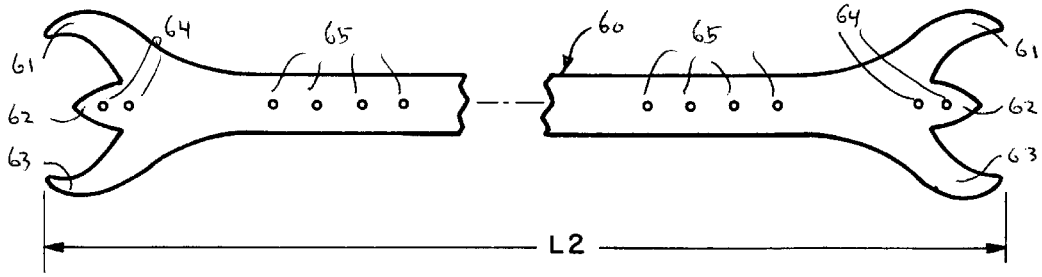
FIG. 10 is a top plan view of a third alternative embodiment of the elongated spar.
Figure 11:
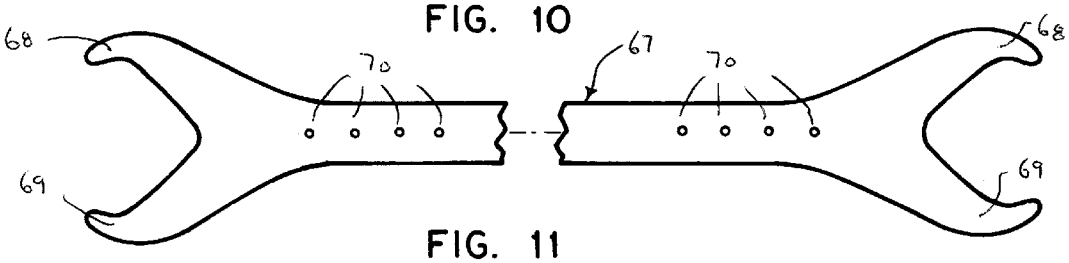
FIG. 11 is a top plan view of a fourth alternative embodiment of the elongated spar.
Figure 9:
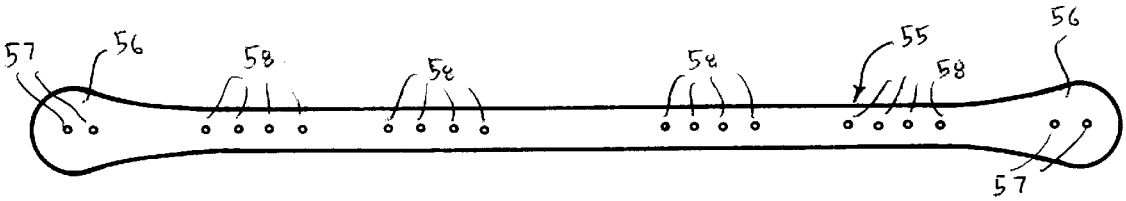
FIG. 9 is a top plan view of a second alternative embodiment of the elongated spar.

The second alternative embodiment elongated spar 55 is illustrated in FIG. 9. It has a bulbous portion 56 formed at its front and rear ends and also has fin attachment apertures 57. Apertures 58 are for the mechanical fastener inserts 38. A third alternative embodiment elongated spar 60 is illustrated in FIG. 10. It has a left finger prong 61, a middle finger prong 62 and a right finger prong 63 formed adjacent its front and rear ends. It has fin attachment apertures 64 and mechanical fastener insert apertures 65. A fifth alternative embodiment elongated spar 67 is illustrated in FIG. 11 and it has a left finger prong 68 and a right finger prong 69 adjacent its front and rear ends. It also has mechanical fastener insert apertures 70.

Figure 12:
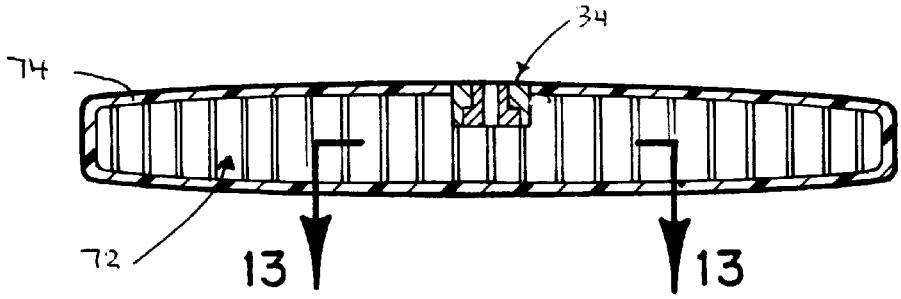
FIG. 12 is a transverse cross sectional view of a first alternative embodiment of the core body.
Figure 13:
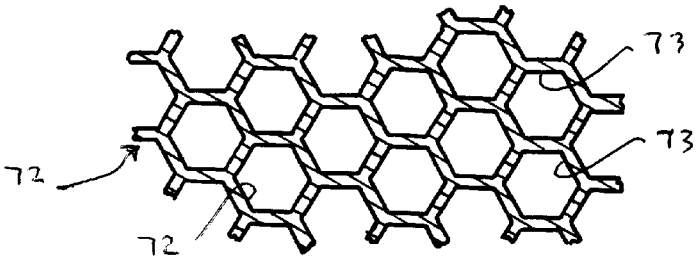
FIG. 13 is a cross sectional view taken along lines 13—13 of FIG. 12.
Figure 14:
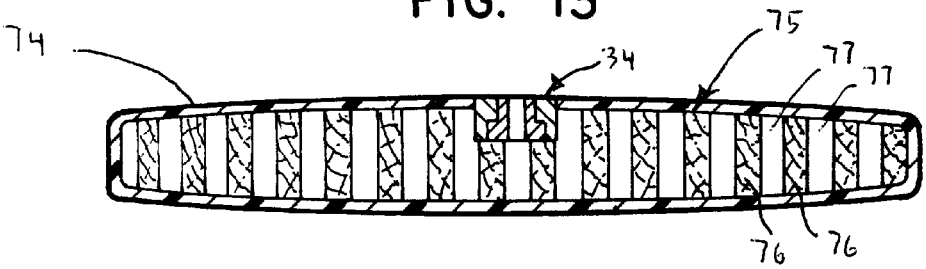
FIG. 14 is a transverse cross sectional view of a second alternative embodiment of an elongated core body.

Alternative embodiment core bodies are illustrated in FIGS. 12–16. In FIGS. 12 and 13, a honey comb core body 72 has an integral matrix with individual cells 73. Core body 72 is preferably formed of aluminum material, however, it could be made of other materials. Core body 72 is covered by a fiberglass coating 74. In FIG. 14, elongated corebody 75 is formed from laminar strips 76 and 77 made of wood or other types of materials such as wood, plastic, composites, titanium etc.

Figure 15:
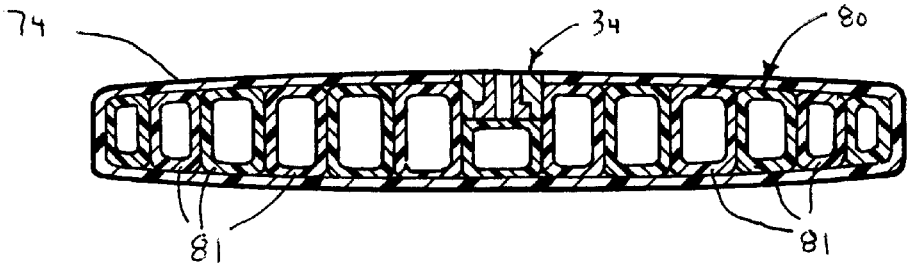
FIG. 15 is a transverse cross sectional view of a third alternative embodiment of the elongated core body.
Figure 16:
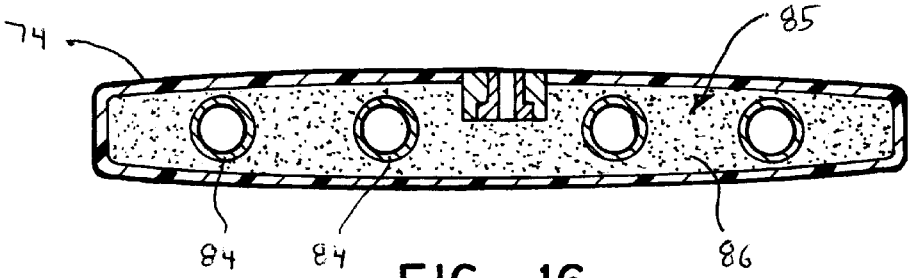
FIG. 16 is a transverse cross sectional view of a fourth alternative embodiment of the elongated core body.

In FIG. 15 elongated core body 80 is formed from braided fiber tubes 81 that run the length of the watersport board. The vertical walls of adjacent braided fiber tubes 81 form an I-beam configuration that gives additional strength to the core body. The coating of fiberglass 74 covers the core body. In FIG. 16 elongated core body 85 has a plurality of carbon composite tubes 84 extending longitudinally in the foam core body portion 86.

What is claimed is:

1. A towable watersport board that requires laterally oriented foot bindings comprising:

an elongated core body having a length L1, a height H1, a width W1 at its front end, a width W2 at its rear end, a central width W3 and W3 is greater than either W1 or W2; said core body also having a front end, a rear end, a left edge, a right edge, a top surface, and a bottom surface;

an elongated spar having a length L2, a width W4, a height H2, a top surface, a bottom surface, a front end, a rear end, a left edge and a right edge; a plurality of longitudinally spaced apertures having a predetermined configuration are formed in said top surface of said spar; said apertures being grouped in the following groups; a forward front foot apertures group, a rearward front foot apertures groups, a forward rear foot apertures group and a rearward rear foot apertures group; L2 is at least 60% of the length L1;

a plurality of mechanical fastener inserts each having a top end, a bottom end, a vertically oriented threaded bore hole in said top end and a height H3;

said mechanical fastener inserts positioned in said respective apertures in said elongated spar; and said core body being covered by a fiberglass coating.

2. A towable watersport board as recited in claim 1 wherein said front end and said rear end of said elongated spar narrows to a point.

3. A towable watersport board as recited in claim 1 wherein said apertures in said elongated spar have a top end and a bottom end and the width of said apertures at their bottom end is greater than the width at their top end.

4. A towable watersport board as recited in claim 1 wherein said elongated spar has fin attachment apertures adjacent said front and rear ends.

5. A towable watersport board as recited in claim 1 wherein said elongated spar has a bulbous portion formed adjacent said front and rear ends and said bulbous portions have a diameter greater than W4.

6. A towable watersport board as recited in claim 1 wherein said elongated spar has a left finger prong and a right finger prong extending from said front and rear ends.

7. A towable watersport board as recited in claim 6 further comprising a middle finger prong extending from said front and rear ends of said elongated spar.

8. A towable watersport board as recited in claim 1 wherein said core body is formed of a foam plastic material.

9. A towable watersport board as recited in claim 1 wherein said core body is formed of vertically oriented longitudinally extending laminar strips.

10. A towable watersport board as recited in claim 1 wherein said core body is formed of longitudinally extending braided fiber tubes positioned laterally side by side with each other.

11. A towable watersport board as recited in claim 8 further comprising at least one longitudinally extending carbon fiber tube in said foam core body.

12. A towable watersport board as recited in claim 1 wherein L1 is in the range of 46–60 inches and W3 is in the range of 13–18 inches.

13. A towable watersport board as recited in claim 1 where W4 is in the range of 0.75–6.0 inches.

* * * * *